US010029839B2

(12) United States Patent
Castex et al.

(10) Patent No.: US 10,029,839 B2
(45) Date of Patent: Jul. 24, 2018

(54) ARTICLE INCLUDING A BOTTLE OF COSMETIC PRODUCT AND A PACK

(71) Applicant: CHANEL PARFUMS BEAUTE, Neuilly sur Seine (FR)

(72) Inventors: Nicolas Castex, Colombes (FR); Sylvie Legastelois, Asnieres sur Seine (FR); Olivier Perrin, Chatillon (FR)

(73) Assignee: Chanel Parfums Beaute, Neuilly sur Seine (FR)

( * ) Notice: Subject to any disclaimer, the term of this patent is extended or adjusted under 35 U.S.C. 154(b) by 0 days.

(21) Appl. No.: 15/109,155

(22) PCT Filed: Dec. 16, 2014

(86) PCT No.: PCT/FR2014/053366
§ 371 (c)(1),
(2) Date: Jun. 30, 2016

(87) PCT Pub. No.: WO2015/104472
PCT Pub. Date: Jul. 16, 2015

(65) Prior Publication Data

US 2016/0325907 A1 Nov. 10, 2016

(30) Foreign Application Priority Data

Jan. 8, 2014 (FR) ..... 14 50112

(51) Int. Cl.
*B65D 81/113* (2006.01)
*B65D 77/04* (2006.01)
(Continued)

(52) U.S. Cl.
CPC ..... *B65D 77/0433* (2013.01); *A45D 34/02* (2013.01); *B65D 5/5038* (2013.01);
(Continued)

(58) Field of Classification Search
CPC ..... B65D 5/5088; B65D 5/5038; B65D 77/0433; B65D 77/0426; B65D 81/133;
(Continued)

(56) References Cited

U.S. PATENT DOCUMENTS

D157,468 S * 2/1950 Burger ..... 273/160
2,993,587 A * 7/1961 Stone ..... B65D 5/5026 206/471
(Continued)

FOREIGN PATENT DOCUMENTS

CN 1843862 A 10/2006
CN 201074100 Y 6/2008
(Continued)

OTHER PUBLICATIONS

Written Opinion of the International Search Report PCT/ISA/210 for International Application No. PCT/FR2014/053366 dated Apr. 10, 2015.
(Continued)

*Primary Examiner* — J. Gregory Pickett
*Assistant Examiner* — Gideon Weinerth
(74) *Attorney, Agent, or Firm* — Harness, Dickey & Pierce, P.L.C.

(57) ABSTRACT

The invention relates to an article which comprises a bottle of cosmetic product and a pack. The pack includes at least one wall having at least one region in relief suggesting, or even reproducing, a bottle shape so as to immobilize it with respect to the wall. The invention also relates to a pack for a bottle of cosmetic product and a method for removing a bottle of cosmetic product from a case.

16 Claims, 4 Drawing Sheets

Figure 1:
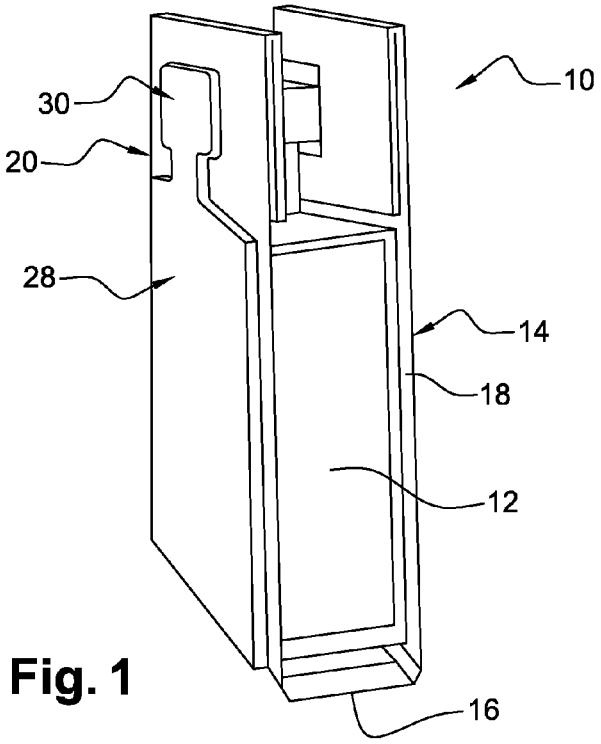

(51) Int. Cl.
*B65D 81/133* (2006.01)
*B65D 5/50* (2006.01)
*A45D 34/02* (2006.01)

(52) U.S. Cl.
CPC ..... *B65D 5/5088* (2013.01); *B65D 77/0426* (2013.01); *B65D 81/133* (2013.01)

(58) Field of Classification Search
CPC ..... B65D 2571/00808; B65D 2571/00814; B65D 5/18; A45D 34/02
USPC ..... 220/23.87, 509, DIG. 2; 229/122.23, 229/122.24, 122.32; D9/738; 217/19
See application file for complete search history.

(56) References Cited

U.S. PATENT DOCUMENTS 3,203,542 A 8/1965 Lightner et al.
3,400,873 A * 9/1968 Bessett ..... B65D 5/5088 206/499
3,800,998 A * 4/1974 Gask ..... B65D 75/225 206/362.4
3,908,826 A * 9/1975 Faller ..... B65D 73/0092 206/463
3,987,956 A * 10/1976 Congleton ..... A01G 9/104 206/423
5,096,650 A * 3/1992 Renna ..... B31F 1/0077 162/226
5,170,886 A 12/1992 Holzner
5,577,614 A 11/1996 Palmeroni, Jr. et al.
5,582,293 A * 12/1996 Kay ..... B65D 5/4204 206/457
6,199,721 B1 * 3/2001 Dunham ..... A47F 1/082 206/467
D441,645 S * 5/2001 Longhurst ..... D9/415
9,139,349 B2 * 9/2015 Lu ..... B65D 81/05
2003/0062286 A1 * 4/2003 Igarashi ..... B65D 81/052 206/522
2003/0116468 A1 * 6/2003 Schwester ..... B65D 5/503 206/592
2015/0291333 A1 * 10/2015 Pitt ..... B65D 71/70 206/427
2016/0175197 A1 * 6/2016 Larson ..... A61J 1/16 206/459.5

FOREIGN PATENT DOCUMENTS

CN 101348184 A 1/2009
CN 201292082 Y 8/2009
EP 0489269 A1 6/1992
FR 2152473 A1 4/1973
FR 2867163 A1 9/2005
FR 2871142 A1 12/2005
JP 1995-015570 3/1995
JP 3010734 U 5/1995
JP 2000-191051 A 7/2000
JP 2010-222755 A 10/2010
JP 2011-038198 A 2/2011
JP 48-18571 B2 11/2011
NL 1039693 C 12/2013
WO WO-2010/042847 A1 4/2010

OTHER PUBLICATIONS

Chinese Office Action dated May 19, 2017 for corresponding Chinese Patent Application No. 201480072241.5.
International Search Report PCT/ISA/210 for International Application No. PCT/FR2014/053366 dated Apr. 10, 2015.
Japanese Office Action dated Oct. 17, 2017 for corresponding Japanese Application No. 2016-544463.
Chinese Office Action dated Feb. 26, 2018 for corresponding Chinese Patent Application No. 201480072241.5.
Notice of Reasons for Rejection dated May 29, 2018 for corresponding Japanese Application No. 2016-544463.

* cited by examiner

ARTICLE INCLUDING A BOTTLE OF COSMETIC PRODUCT AND A PACK

CROSS-REFERENCE TO RELATED APPLICATIONS

This application is the U.S. National Phase application of PCT Application No. PCT/FR2014/053366 filed on Dec. 16, 2014, which claims priority to French Patent Application No. 1450112 filed on Jan. 8, 2014, the contents of each of which are incorporated herein by reference.

The invention relates to the packaging and protection of bottles of cosmetic products, such as perfume.

A perfume bottle is generally made of glass and is considered to be fragile. It is presented in a folded cardboard pack which protects the bottle against shocks on all sides. The bottle and the pack are slipped into a cardboard case which bears in particular the name of the product.

However, to effectively protect the bottle against shocks, the pack has numerous cutouts and folds, which also produces a lot of waste during manufacture. Furthermore, the pack cannot be used without a case since it does not allow aesthetic presentation of the bottle.

The main objective of the invention is to propose a simpler pack which may possibly be used without a case. The invention also aims to improve the protection of the bottle against shocks.

The invention therefore relates to an article comprising a bottle of cosmetic product and a pack comprising at least one wall having at least one region in relief suggesting, or even reproducing, a shape of the bottle so as to immobilize it with respect to the wall.

Thus, the bottle can be housed in the region in relief to be protected from the shocks. In addition, the shape of the region in relief can be used to identify the bottle when it is in the pack. The article could therefore be displayed on shelves without necessarily requiring a case to identify the bottle. Furthermore, the bottle is immobilized in the pack simply by assembling the bottle and the wall.

Preferably, the region in relief forms at least one boss extending from one end edge to another of the region in relief.

Thus, the bottle is housed in the boss which reproduces a shape of the bottle. Advantageously, the shape of the boss comprises a shape of the bottle reservoir.

Even more advantageously, the shape of the boss comprises a shape of the bottle cap.

The shape of the boss may also comprise a shape of a bottle neck.

Preferably, the wall comprises a free end having at least two outer and inner thicknesses, the outer thickness comprising the region in relief and the inner thickness(es) comprising a cutout reproducing a section of the cap, the region in relief and the cutout(s) cooperating with the bottle cap so as to immobilize it with respect to the wall.

Due to the shape of the cutout of the inner thickness, the cap is immobilized with respect to the wall over a thickness corresponding to the depth of the region in relief and of the two wall thicknesses. The bottle is therefore immobilized securely.

When the free end has three thicknesses, one outer thickness and two inner thicknesses, the cap is immobilized with respect to the wall over a thickness corresponding to the depth of the region in relief and of the three wall thicknesses.

In addition, the presence of at least one outer thickness and one inner thickness stiffens the free end of the wall.

These different thicknesses are, for example, obtained by folding the free end on itself.

Thus, the plurality of thicknesses is obtained from a single wall. The inner thicknesses are used to compensate the dimensional differences between the cap and the bottle reservoir when they have different widths. Blocking of the cap is however optional and the bottle could be blocked only by the reservoir.

Advantageously, the pack comprises two walls which sandwich the bottle, each wall having at least one region in relief.

The bottle is therefore immobilized with respect to each of the walls and is protected on at least two opposite sides.

Preferably, the pack is generally U-shaped having a core extended by the two walls, the bottle and the juice it contains preferably being visible on at least two opposite sides of the core.

The pack is therefore made of a single piece and protects the bottle on at least three of its sides, the bottle being visible on at least two sides, for example two lateral sides, or even on three sides. We therefore obtain effective protection of the bottle against shocks while reducing production costs, since the pack is not present on all sides of the bottle. In addition, the bottle and its juice are visible even when it is protected by the pack.

The bottle may also comprise a bottom and the pack may comprise at least one region in relief, called damping region, in contact with at least one part of the bottom so as to protect the bottom of the bottle against shocks, the damping region being for example carried by a tab, preferably formed by folding.

Thus, the bottom of the bottle rests on a damping region, preferably on two damping regions, which protects it against shocks, for example during the various handling steps such as putting the article on shelves.

Advantageously, the pack includes long-fiber cardboard.

Long-fiber cardboard offers the advantage that it can be shaped in ways other than by cutting and folding. Thus, the regions in relief can be made by stamping or embossing the wall. Long-fiber cardboard means in particular cardboard comprising a majority of fibers more than 2 mm long, and preferably more than 3 mm long. Long-fiber cardboard is also a cardboard whose surface finish can form a sign, for example the product name and/or brand.

For example, the pack has two layers of long-fiber cardboard separated by corrugated cardboard.

The result is therefore a good compromise between stiffness, weight and cost of the pack while ensuring good protection against shocks. The corrugated cardboard increases the wall thickness while separating the two layers of long-fiber cardboard and dampens the shocks.

Preferably, the corrugated cardboard is made of short fibers.

Short-fiber cardboard means in particular cardboard comprising a majority of fibers less than 2 mm long, and preferably less than 1 mm long. The density of short-fiber cardboard is less than that of long-fiber cardboard, which reduces the weight of the pack.

The pack may comprise a material selected from wood, metal, a thermoplastic material or a mixture of paper pulp and polymer.

Advantageously, the inherent elasticity of the pack material is such that, without external stress, when the pack is placed on a horizontal surface immediately after unpacking the article, its walls form together an angle of at least 30°.

Thus, since the free ends of the walls move away from each other, the bottle is easily accessible, without handling the pack. (However, it is understood that after several handling operations, the angle may be less than 30°.)

The article may also comprise means for keeping the pack in contact with the bottle, for example a case.

The case may allow all or part of the pack to be seen. Thus, the shape of the bottle suggested, or even reproduced, can be seen on the pack when the case keeps the pack in contact with the bottle.

The pack may bear one or more signs.

Thus, the bottle can be displayed on the shelves in the pack without using a case bearing the product name and/or brand. Generally, the cases for cosmetic products undergo several marking steps which are expensive and polluting. Since the shape of the bottle is suggested, or even reproduced, on the pack, the user can easily identify the product. Thus, simple and relatively non-polluting marking of the pack can be used.

The bottle may comprise two substantially flat main sides.

In addition, the cap width may be substantially equal to the reservoir width.

The invention also relates to a pack for a bottle of cosmetic product having at least one wall with at least one region in relief suggesting, or even reproducing, a bottle shape.

The invention also relates to a method for removing a bottle of cosmetic product from a case comprising a pack, the method comprising the following steps:

taking the bottle, for example by a cap, without opening the pack, and removing the bottle from the pack without completely removing the pack from the case.

The method for removing the bottle is therefore extremely simple, quick and intuitive for the user. Since the pack remains partially in the case, in order to put the bottle back in the case, the bottle is simply inserted in the pack and pushed into the case.

Figure 2:
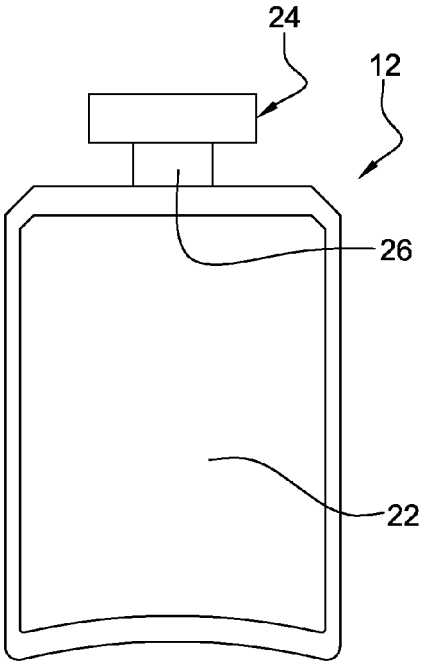
Figure 3:
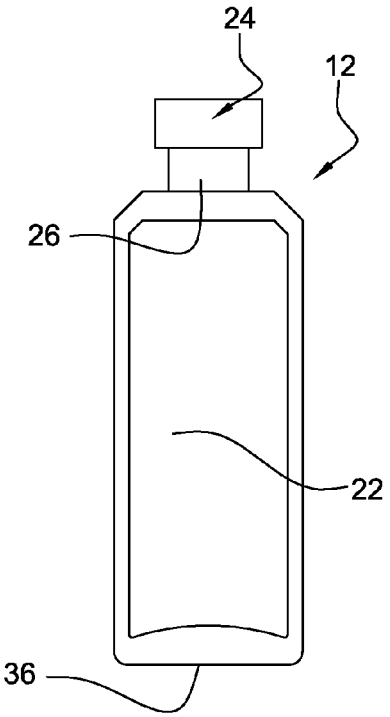
Figure 4:
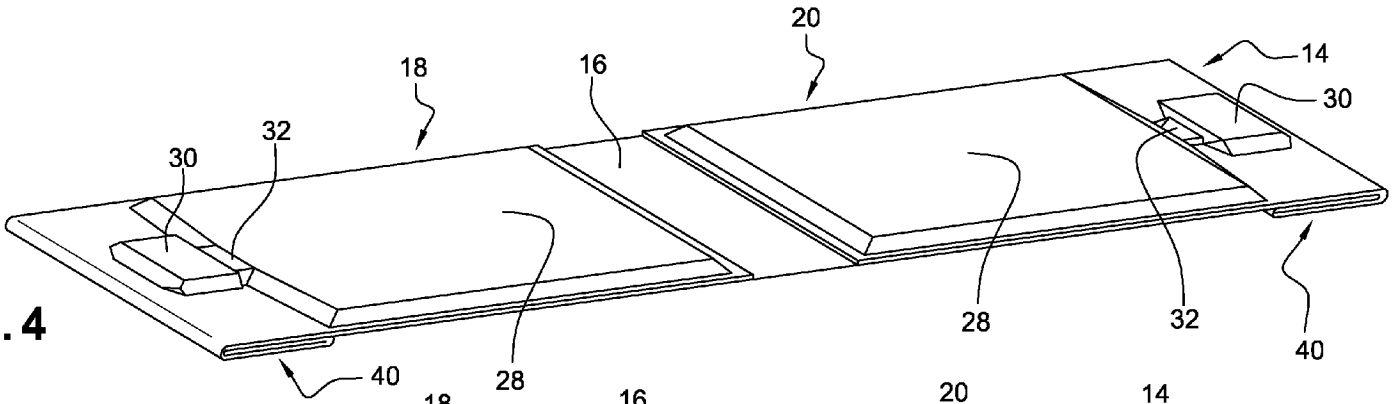
Figure 5:
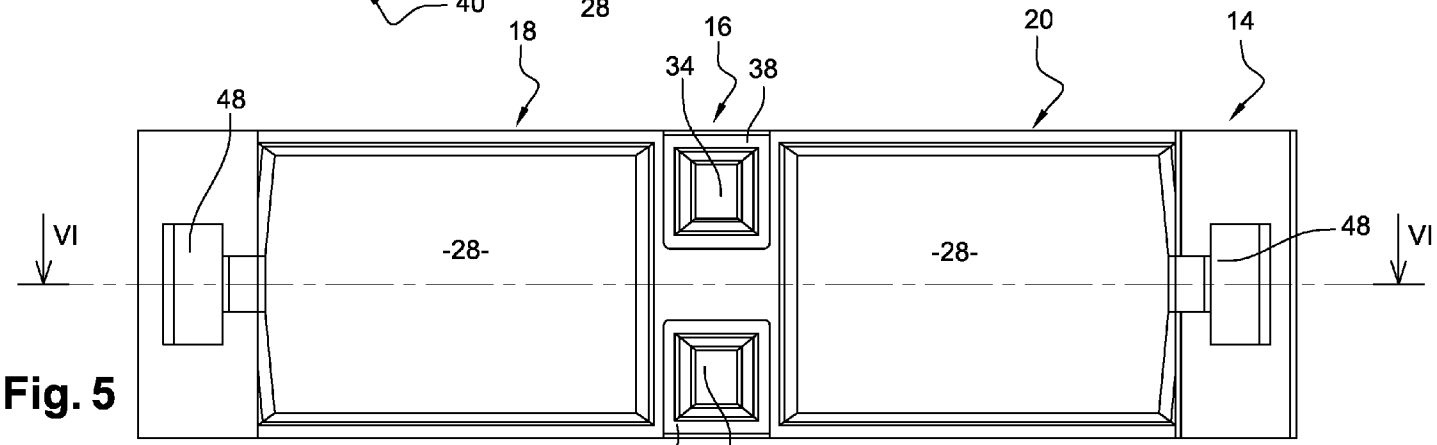
Figure 6:
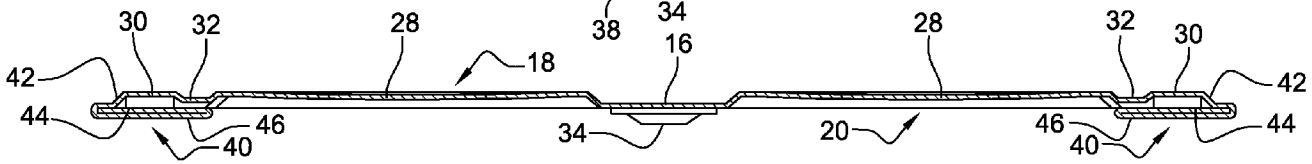
Figure 7:
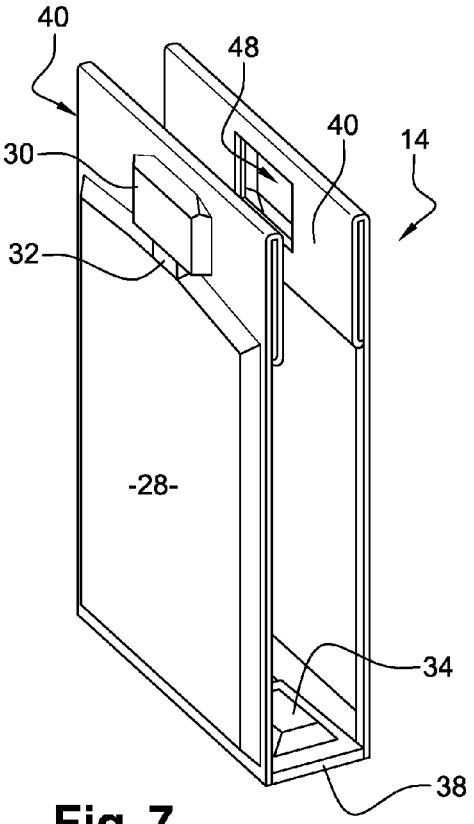
Figure 8:
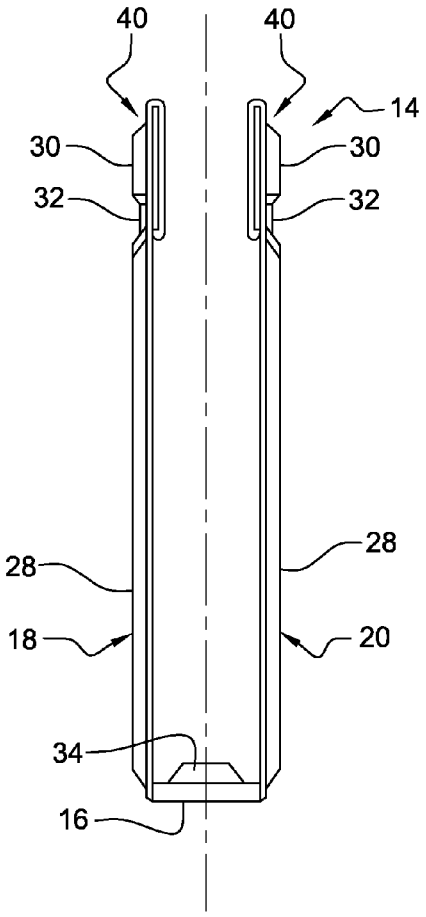
Figure 9:
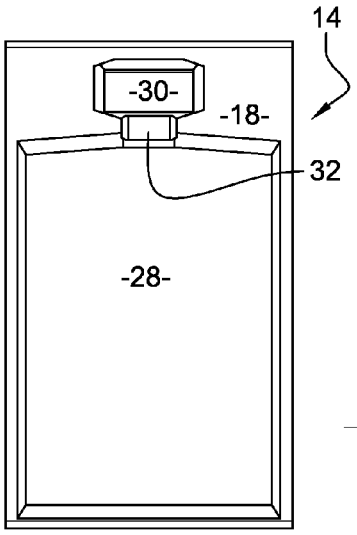
Figure 10:
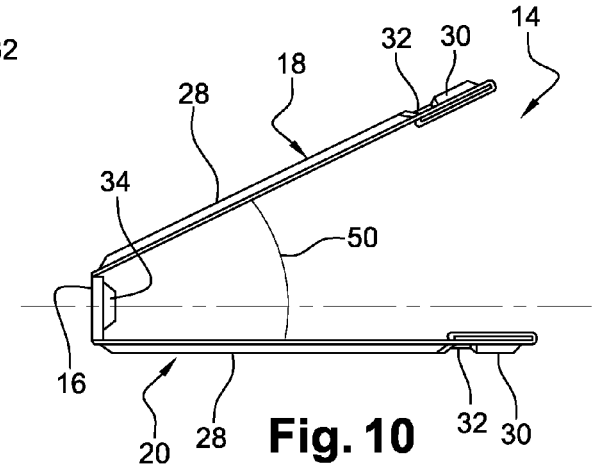
Figure 11:
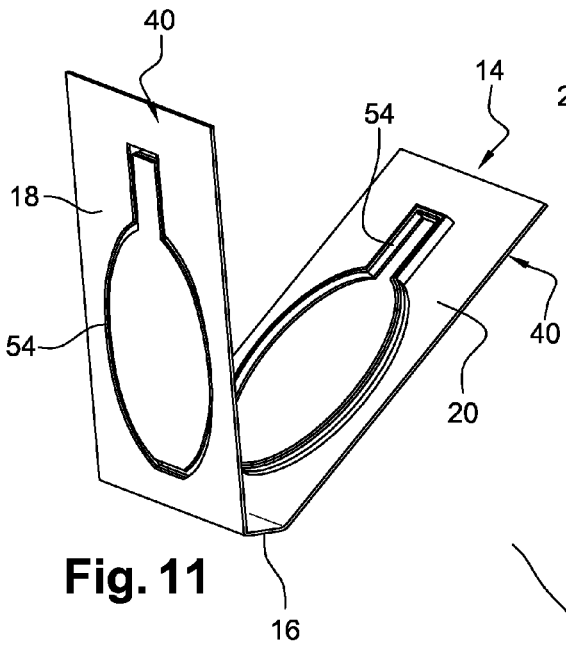
Figure 12:
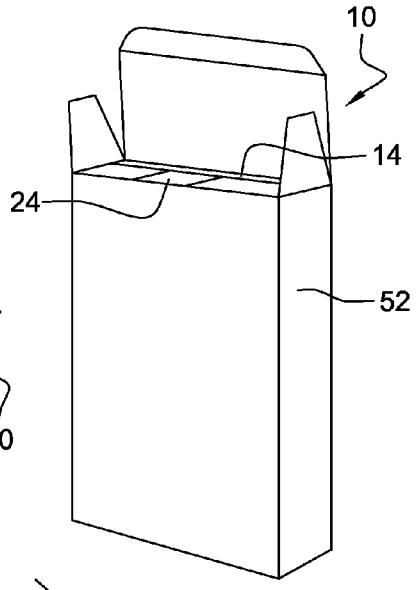
Figure 13:
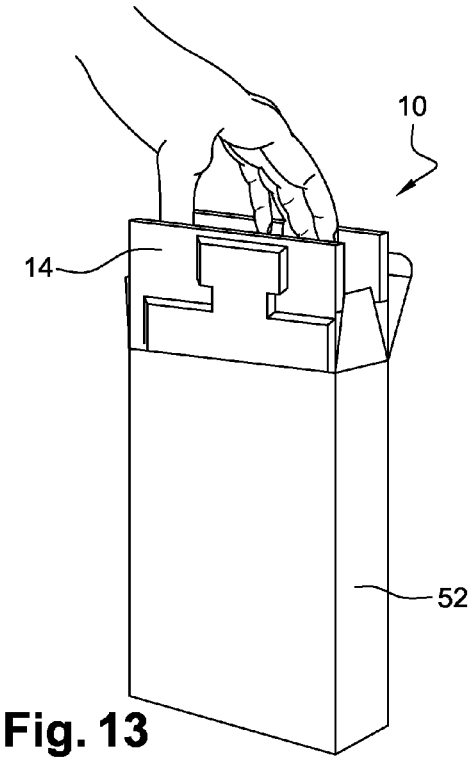
Figure 14:
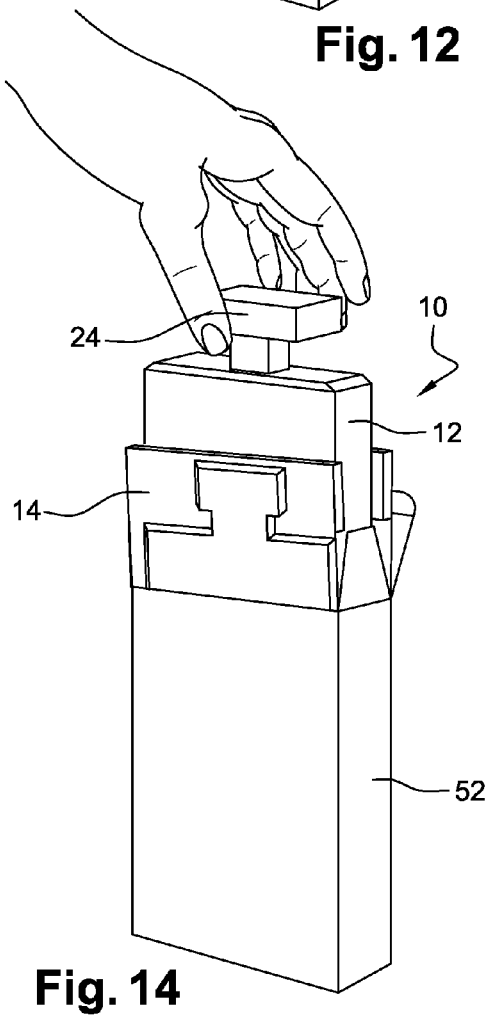

We will now describe embodiments of the invention, referring to the attached drawings in which:

FIG. 1 is a perspective view of an article according to an embodiment of the invention, FIGS. 2 and 3 are front and side views of the bottle of the article shown on FIG. 1, FIG. 4 is a perspective view of the outside of the pack of the article shown on FIG. 1, the pack being developed, FIG. 5 is a top view of the inside of the pack shown on FIG. 4, FIG. 6 is a sectional view along the plane IV-IV of the pack shown on FIG. 5, FIGS. 7 to 9 are perspective, side and front views of the pack, FIG. 10 is a side view of the pack immediately after unpacking the article, FIG. 11 illustrates an alternative implementation of the invention, FIGS. 12 to 14 are perspective views illustrating a method for removing the bottle from the pack of the article shown on FIG. 1.

We will describe an embodiment of the article of the invention, referring to FIGS. 1 to 10.

FIG. 1 is a general figure, and shows an article 10 comprising a bottle 12 of cosmetic product, in this case a glass perfume bottle, and a pack 14.

The pack 14 is generally U-shaped and has a core 16 extended by two walls 18, 20, which sandwich the bottle 12. The pack 14 is made of a single piece and covers the bottle 12 on at least three of its sides. The bottle 12 and the juice it contains are visible on two of its lateral sides, for example two lateral sides opposite each other with respect to the core 16. The bottle 12 can also be seen from the top, on the side opposite the core 16. The bottle 12 and its juice are therefore visible even when it is protected by the pack.

The bottle 12 comprises a reservoir 22 and a cap 24. In the embodiment shown on FIGS. 2 and 3, the reservoir 22 has a generally rectangular shape, its opposite sides being parallel in pairs and substantially flat. The bottle 12 also has a neck 26 and the width of the cap 24 is substantially equal to the width of the reservoir 22.

FIGS. 4 to 6 are more detailed views of the pack 14 developed. In this configuration, the pack has a generally rectangular shape. The walls 18 and 20 and the core 16 also each have a generally rectangular shape. The core is adjacent to the walls 18, 20 along its longitudinal sides. Apart from the extra thicknesses which will be described below, the pack consists in this case of the core and the two walls 18, 20.

Each wall 18, 20 has three regions 28, 30, 32 extending in relief of a plane from the outer side of the wall. The regions reproduce a shape of the bottle 12. In this case, the regions in relief 28, 30 and 32 reproduce respectively a shape of the reservoir 22, a shape of the cap 24 and a shape of the neck 26 of the reservoir.

Each region in relief 28, 30, 32 forms a boss when the pack is seen from the outside and a hollow when the pack is seen from the inside. The boss extends from one end edge to another of the region in relief 28, 30, 32. Thus, as shown on FIG. 1, when the bottle 12 and the pack 14 are assembled, the reservoir 22, the cap 24 and the neck 26 are housed therein so as to immobilize the bottle 12 with respect to the walls 18, 20.

Thus, the regions in relief 28, 30, 32 block the bottle in the pack.

As an indication, for a bottle 12 having a width of about 3 cm, the depth of the bosses is about 2.5 mm. Thus, although the bottle 12 is partially housed in the regions in relief 28, 30, 32, the lateral sides of the bottle 12 are visible even when the bottle is protected by the pack 14, as shown on FIG. 1.

Since the bosses reproduce the shape of the bottle 12, its shape can be recognized and the bottle identified even when it is in the pack 14, as shown on FIG. 9.

The core 16 comprises two damping regions extending in relief from an internal side of the core. Each damping region 34 is carried by a tab 38 folded over on a first thickness of the core 16. The two damping regions are close to the respective ends of the core.

Thus, the bottle 12 having a bottom 36, when it is housed in the pack 14, the bottom 36 rests on the two damping regions 34. The bottom 36 of the bottle is therefore protected against shocks.

The damping regions 34 are however optional. The bottle 12 could be suspended in the pack 14, with its bottom 36 not resting on any region of the pack 14. Also, the damping regions 34, if present, could be made differently. For example, they could be formed by bosses similar to the regions in relief 28, 30, 32, the top of the boss(es) being directed towards the bottle 12 or in the opposite direction. An added-on damping element could also be used, such as a small block of foam, an elastic strip, elastomer pads or any other means.

In addition, each wall 18, 20 comprises near its edge opposite to the core a free end 40 which in this case has three thicknesses, an outer thickness 42 and two inner thicknesses 44, 46. In this case, the inner thicknesses 44, 46 are obtained by folding the free end 40 on itself. In addition, this plurality of thicknesses stiffens the free end 40 of each wall 18, 20.

The outer thickness 42 comprises the regions in relief 30, 32 reproducing a shape of the cap 24 and of the neck 26 and each of the inner thicknesses 44, 46 has a cutout 48 reproducing a section of the cap 24 and of the neck 26. The cutouts have the same shape and same dimensions as the associated region in relief and are positioned in coincidence with it. The cap 24 and the neck 26 are therefore immobilized with respect to each wall 18, 20 by the cutouts 48 and by the regions in relief 30, 32.

Thus, the regions in relief 28, 30, 32 and the cutouts 48 completely block the bottle in the pack. The various inner thicknesses 44, 46 block the cap 24. Advantageously, if the width of the cap 24 is different from that of the reservoir 22, the inner thicknesses 44, 46 compensate for the difference in width. More than two inner thicknesses 44, 46 could be used. The regions 30 and 32 are nevertheless optional and the cap 24 could be blocked by no region of the pack 14.

The pack 14 can be made from long-fiber cardboard, wood, metal, a thermoplastic material or a mixture of paper pulp and polymer.

The regions in relief 28, 30, 32, 34 are for example obtained by stamping or embossing the sheet of material. In this case, the pack 14 is made from two layers of long-fiber cardboard separated by short-fiber corrugated cardboard.

As shown on FIG. 10, the material of the pack 14 has in this case inherent elasticity such that, without external stress, when it is placed on a horizontal surface immediately after unpacking the article 10, the walls 18, 20 form together an angle 50 of at least 30°.

In the remainder of the document, elements common to the various embodiments are identified by the same reference numbers.

FIG. 11 shows a second embodiment of the pack 14 in which the pack 14 is generally U-shaped and whose core 16 is extended by the two walls 18, 20 intended to sandwich the bottle 12. The pack 14 is made of a single piece and covers the bottle 12 on at least three of its sides. In this embodiment, the region in relief is a hollow groove 54, when the pack 14 is seen from the outside, which reproduces the shape of the bottle 12. The groove 54 is in relief when the pack 14 is seen from the inside. In this embodiment, the groove 54 is continuous but it could also not be continuous and simply suggest a shape of the bottle 12.

In this embodiment, the reservoir 22 of the bottle has a generally cylindrical shape, its opposite sides being parallel in pairs, circular and substantially flat. The bottle 12 may have a neck 26 and comprise a cap 24 whose width is substantially equal to the width of the reservoir 22.

As can be seen on FIG. 10, the free end 40 of the pack 14 does not have a plurality of thicknesses and the core 16 has no damping regions. Thus, when the bottle 12 is sandwiched between the two walls 18 and 20, the bottom of the bottle 12 is not in contact with the core 16 of the pack 14.

FIG. 12 shows means for keeping the pack 14 in contact with the bottle 12, these means being formed by a case 52 in which the pack and the bottle are housed having the configuration of FIG. 1 in which the bottle is protected by the pack. The case has a generally rectangular shape closed on all sides except on its top side which comprises a pivoting flap or cover and two side tabs.

We will describe a method for removing the bottle 12 from the case 52 which comprises the pack 14 with reference to FIGS. 12 to 14.

FIG. 12 shows the case 52 open. As soon as the user has opened the case 52, he/she can see the bottle 12 and in particular the cap 24 of the bottle. The user takes the bottle 12 by the cap 24 without opening the pack 14 and, by pulling on the cap, removes the bottle from the pack. As shown on FIG. 13, since the bottle 12 is sandwiched between the two walls 18, 20 of the pack, when the user pulls on the cap 24, the pack also comes partially out of the case 52. Due to the natural elasticity of the pack material, once the pack is partially out of the case, the two free ends 40 of the walls 18, 20 move away from each other and release the bottle 12, as shown on FIG. 14. The user therefore holds the bottle only, still by the cap.

The reverse operation can be performed to put back the bottle and pack in the case.

Obviously, the user can hold the bottle 12 by a part which is not the cap.

The user can also slide the pack 14 out of the case 52, for example by tilting the latter and/or holding the pack directly to remove it completely or partially from the case.

As soon as the pack 14 is sufficiently out of the case 52, due to the arrangement of the pack, the two free ends 40 of the walls 18, 20 move away from each other allowing the user to take the bottle 12.

Alternatively, the user can remove the pack completely from the case and place it on a flat surface, due to the natural elasticity of the material, the two free ends 40 of the walls 18, 20 move away from each other and release the bottle 12 by forming an angle 50 of at least 30°.

Obviously, numerous modifications can be made without leaving the scope of the invention.

In particular, the sides of the bottle may not be flat, the cap width may be different from that of the reservoir, the holding means may comprise a transparent strip, an open case or a tab.

In addition, the region in relief may be a hollow groove, when the pack is seen from the outside, which reproduces a shape of the bottle. This groove may not be continuous and simply suggest a shape of the bottle.

A recess could also be provided in at least one of the regions 28 and 30 of the two walls so that a label of the bottle 12 is visible even when the bottle is covered by the pack.

The invention is not limited to perfume bottles and can be used for the packaging and protection of bottles of other cosmetic products. Furthermore, the bottle may have two substantially flat and circular main sides. However, the invention is not limited to the packaging and protection of bottles having two main sides which are flat. Thus, the bottle may have convex sides or even have a cylindrical or spherical reservoir.

Furthermore, note that the fact that the bottle can be seen, especially on its sides, when it is protected within the pack, is independent of the presence of regions in relief carried by the pack. The pack could, for example, have no regions in relief and be generally U-shaped in order to see the bottle on at least two opposite sides of the pack.

The invention claimed is:

1. An article, comprising:

a bottle of cosmetic product, the bottle including at least a reservoir and a cap and a U-shaped pack including two opposite walls connected via a core, each of the two opposite walls including at least one region in relief configured to encase at least a portion of the reservoir and the cap at opposite sides of the bottle;

wherein at least one other side of the pack that does not include one of the two opposite walls is open.

2. The article according to claim 1, wherein the at least one region in relief forms at least one boss extending from one end edge of the at least one region to another end edge of the at least one region.

3. The article according to claim 2, wherein a shape of the at least one boss comprises a shape of the reservoir.

4. The article according to claim 2, wherein a shape of the at least one boss comprises a shape of the cap.

5. The article according to claim 4, wherein the at least one of the two opposite walls comprises a free end having at least two outer and inner thicknesses, the outer thickness comprising the at least one region in relief and the inner thickness comprising a cutout reproducing a section of the cap, the at least one region in relief and the cutout being configured to encase the cap.

6. The article according to claim 1, wherein the bottle is visible on at least two opposite sides of the pack.

7. The article according to claim 1, wherein the bottle comprises a bottom and the pack comprises a damping region in contact with at least one part of the bottom and configured to protect the bottom of the bottle against impact, the damping region being carried by a tab.

8. The article of claim 7, wherein the tab is formed by folding.

9. The article according to claim 1, wherein the pack includes two layers of long-fiber cardboard separated by corrugated cardboard.

10. The article of claim 9, wherein the corrugated cardboard includes short fibers.

11. The article of claim 1, wherein:

the bottle further includes a neck between the reservoir and the cap; and the two opposite walls further include at least one region in relief configured to encase at least a portion of the neck at the opposite sides of the bottle.

12. The article of claim 1, further comprising a case configured to hold the bottle and the pack;

wherein the bottle is configured to be removed from the pack without the pack being completely removed from the case.

13. The article according to claim 1, wherein an inherent elasticity of the pack material is such that when the pack is placed on a horizontal surface, the two opposite walls form an angle of at least 30°.

14. A pack for a bottle of cosmetic product, the bottle including a reservoir and a cap, the pack being U-shaped and comprising two opposite walls connected via a core, each of the two opposite walls including at least one region in relief configured to encase at least a portion of the reservoir and the cap;

wherein at least one other side of the pack that does not include one of the two opposite walls is open.

15. The pack of claim 14, wherein the two opposite walls further include at least one region in relief configured to encase at least a portion of a neck of the bottle at the opposite sides of the bottle.

16. A method for removing a bottle of cosmetic product from a case including a pack, the bottle including a reservoir and a cap, the method comprising:

grasping the bottle, by the cap of the bottle, without opening the pack, the pack being a U-shaped pack and including two opposite walls connected via a core, each of the two opposite walls including at least one region in relief configured to encase at least a portion of the reservoir and the cap; and removing the bottle from the pack without completely removing the pack from the case.

* * * * *